United States Patent [19]

Chandler

[11] Patent Number: 4,788,899

[45] Date of Patent: Dec. 6, 1988

[54] AMMUNITION WITH INTERNAL LIGHT-SETTABLE PICKUP ARRANGEMENT FOR DIGITAL MEMORY STORAGE

[75] Inventor: Charles E. Chandler, Cockeysville, Md.

[73] Assignee: AAI Corporation, Hunt Valley, Md.

[21] Appl. No.: 294,254

[22] Filed: Aug. 19, 1981

[51] Int. Cl.[4] ..... F42C 17/00

[52] U.S. Cl. ..... 89/6; 102/201

[58] Field of Search ..... 102/201, 207; 89/6, 89/6.5

[56] References Cited

U.S. PATENT DOCUMENTS 3,228,337 1/1966 Grantham et al. ..... 102/201
3,500,746 3/1970 Ambrosini ..... 89/6.5
4,091,734 5/1978 Redmond et al. ..... 102/207
4,318,342 3/1982 Chandler ..... 102/207

*Primary Examiner*—Charles T. Jordan
*Attorney, Agent, or Firm*—Reginald F. Pippin, Jr.

[57] ABSTRACT

A projectile having a light-settable photodetector assembly, in the form of a plurality of photovoltaic cell units mounted internally of the projectile, with corresponding respective light passageways, formed preferably by optical fibers, connecting between the exterior of the projectile and the photocell units. Circumferential angular position indexing means is provided on the projectile for index location of an external light source setting device therewith. Each photodetector also electrically connects with an electrical signal storage unit, in the form of a capacitor, which is activated by light acting on the photodetector, thereby enabling inputting and storage of a selected composite digital signal.

12 Claims, 1 Drawing Sheet

AMMUNITION WITH INTERNAL LIGHT-SETTABLE PICKUP ARRANGEMENT FOR DIGITAL MEMORY STORAGE

This invention relates to ammunition in which data is desired to be inputted, such as for actuating a fuze at a selected time interval after firing and launch of the projectile.

Various methods have been employed for inputting data to a projectile, such as for setting a fuze timer, including the use of various mechanically set devices on the projectile body. Such mechanically set data input arrangements require an amount of time for setting of data therein which is incompatible with high rate of fire weapons.

It is an object of this invention to provide a projectile data input arrangement which enables rapid and accurate setting of data into the projectile and/or a projectile fuze.

A further object is the provision of a digital data inputting arrangement for a projectile and/or a fuze in which the data is inputted by utilizing a digital light input.

Still other objects, features and attendant advantages will become apparent from a reading of the following detailed description of a preferred embodiment of the invention, taken in conjunction with the accompanying drawings, wherein.

Figure 1:
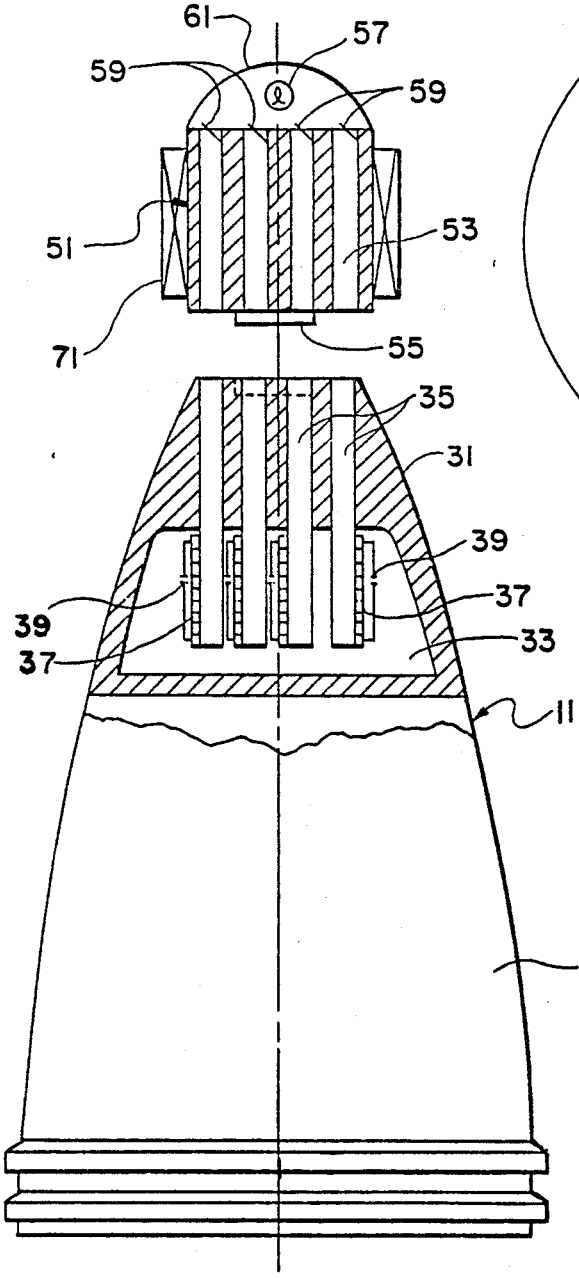
FIG. 1 is a schematic representation of a projectile with a portion of its nose section cut away for clarity of illustration, together with a schematic view of a light setting device.
Figure 2:
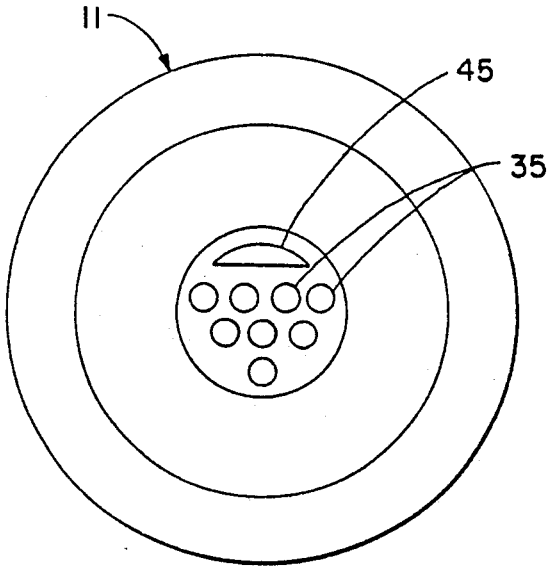
FIG. 2 is a forward end view of the projectile.
Figure 3:
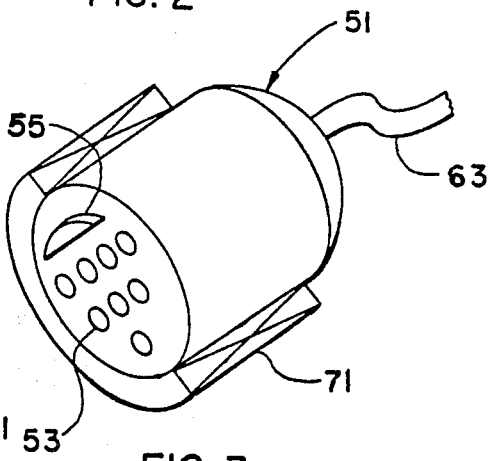
FIG. 3 is a perspective view of the setting device, shown from the mating end.

Referring now in detail to the Figures of the drawing, a projectile 21 having a time-settable fuze 31 is provided with a light settable digital data input arrangement in the form of a plurality of discrete light pipes 35, each formed by one or a bundle of a plurality of optical fibers or other suitable light transmitting media.

Each light pipe 35 communicates from the exterior of the projectile/fuze 21, 31, to an interior data setting location which is shown as a chamber 33, where a data transfer and storage arrangement is located. In the illustrated embodiment the data transfer and storage arrangement takes the form of a discrete photovoltaic cell or cells 37 and an accompanying respective individual charge storage capacity 39 connected across each respective individual discrete cell or group of connected cells 37.

The photovoltaic cells 37 may be disposed at the extreme end of each respective light pipe 35, or preferably may extend along a length of the respective light pipe in which latter event the facing lateral surfacd of the light pipe may be frosted to bring light into the photovoltaic cell 37 along its effective length. The photovoltaic cells 37 may be secured directly to the light pipes if so desired.

The capacitors 39 are only required to hold their charge for a relatively short length of time, as for instance, less than one second, as the data input can be accomplished immediately preceding or during the loading of the round of ammunition into a weapon for firing, with firing being accomplished substantially immediately thereafter. Such short storage times can readily be effected with conventional capacitors. If longer periods are required a more long-term storage medium, such as a flip-flop, may be used or added for each storage element required.

As will be readily apparent to one skilled in the digital electronics art, the capacitors may be connected to any desired electrical timing or other desired user circuit (not shown) which is desired to be employed for actuating the fuze or some other portion of the projectile, as for instance at a subsequent selected time period after firing which selected time period corresponds to the digital input to, and stored as a composite digital signal on the capacitors 39 through passing of a burst of light through selected ones of the light pipes 35 corresponding to the particular digital value desired to be inputted and stored.

The necessary burst of light to the selected photovoltaic cells 37 for any selected composite digital signal may be effected through employment of a detachable input head 51 having a plurality of light openings 53 each disposed in alignable position with the exterior end of a corresponding one of the light pipes 35. An indexing pin 55 thereon fits within a corresponding index slot 45 on the projectile to effect alignment of the openings 53 with light pipes 35.

A common light source 57 may be suitably employed in conjunction with a parabolic reflector 61 and shutters 59 for passing light through selected ones of the openings 53 and light pipes 35 to effect a desired digital input to the projectile/fuze data storage media 39.

Input head 51 may be rotatable, as by mounting in a journal or bearing 71, for indexed alignment with the projectile 21.

Shutters 59 may be of conventional or other desired construction, such as mechanical iris, leaf or slide construction, or electro-optical construction, as for instance err' cells or transmissive liquid crystals in which an individual light passage cell is switched from effective light passage to effective light blocking relation through application of an electrical control signal to the light passage cell. The particular shutter construction does not itself form a part of this invention, and a particular shutter construction is accordingly not shown. However, the electro-optical shutter is preferred in view of its speed and simplicity of operation.

The openings 53 may be suitably formed as simple holes or may also be formed by optical fibers as in the case of light pipes 35. It will be noted that by employment of optical fibers the light passageways may be curved as desired, rather than being simply straight as shown schematically for simplicity and ease of illustration in the drawings. Such complex curvature capability is particularly of value in the event that the data transfer and storage arrangement is more remotely located relative to the setting head, e.g. in some other portion of the projectile than the ogive or nose section.

As an aid to prevention of inputting of false data to the projectile/fuze storage media through light pipes 35. Photovoltaic cells may be employed which are sensitive to selected bandwidths of light, such as the near IR, or ultraviolet, and the user circuit may have a threshold signal storage transfer which requires a high level light input to the photovoltaic cells 37 to effect a usable signal on capacitors 39. While an eight bit input and storage arrangement is shown, it will be apparent that any desired number of bits may be employed within the physical limits of the arrangement.

While the invention has been illustrated and described with respect to a single physical embodiment, it will be apparent that various modifications and improvements may be made without departing from the scope and spirit of the invention. Accordingly, the invention is not to be limited by the specific illustrative embodiment, but only by the scope of the appended claims.

I claim:

1. A projectile having a light-settable photodetector and signal storage arrangement, comprising a projectile body section having a plurality of light passageways formed therein and communicating with an interior section of said projectile, a photovoltaic cell disposed adjacent each of said light passageways at said interior section, and a discrete electrical storage medium connected to each of said photovoltaic cells for compositely registering a composite digital signal transmitted by light through said passageways to said photovoltaic cells.

2. A projectile according to claim 1, said light passageways being formed by optical fibers.

3. A projectile according to claim 1, and indexing means on said projectile for index location of said light passageways with an external source of data input light.

4. A projectile according to claim 1, said discrete electrical storage medium for each photovoltaic cell comprising a respective storage capacitor connected thereto.

5. A projectile according to claim 1, said photovoltaic cells being each disposed along a length of its respective light passageways, said light passageways comprising optical fibers, said fibers being frosted along a longitudinal portion thereof adjacent their respective photovoltaic cell.

6. A fuze having a light-settable photodetector and signal storage arrangement, comprising a fuze body section having a plurality of light passageways formed therein and communicating with an interior section of said fuze, a photovoltaic cell disposed adjacent each of said light passageways at said interior section, and a discrete electrical storage medium connected to each of said photovoltaic cells for compositely registering a composite digital signal transmitted by light through said passageways to said photovoltaic cells.

7. A fuze according to claim 6, said light passageways being formed by optical fibers.

8. A fuze according to claim 6, and indexing means on said fuze for index location of said light passageways with an external source of data input light.

9. A fuze according to claim 6, said discrete electrical storage medium for each photovoltaic cell comprising a respective storage capacitor connected thereto.

10. A fuze according to claim 6, said photovoltaic cells being each disposed along a length of its respective light passageway, said light passageways comprising optical fibers, said fibers being frosted along a longitudinal portion thereof adjacent their respective photovoltaic cell.

11. The combination of a projectile according to claim 1, and a light signal setting head, said setting head comprising, a body having a plurality of light passageways corresponding to the light passageways of said projectile and alignable therewith, indexing means for alignment of said setting head light passageways with said projectile light passageways, a light source, and selectively individually actuatable shutter means for each of said setting head light passageways.

12. The combination according to claim 11, each of said setting head light passageways being formed by optical fibers.

* * * * *